United States Patent [19]

Lee

[11] 4,286,753

[45] Sep. 1, 1981

[54] COMBINATION WOOD PLASTIC RAILROAD TIE

[75] Inventor: Hong Man Lee, White Plains, N.Y.

[73] Assignee: Champion International Corporation, Stamford, Conn.

[21] Appl. No.: 661,267

[22] Filed: Feb. 25, 1976

Related U.S. Application Data

[63] Continuation of Ser. No. 516,586, Oct. 21, 1974, abandoned.

[51] Int. Cl.[3] ..... E01B 3/10

[52] U.S. Cl. ..... 238/37; 238/83; 428/106; 428/529

[58] Field of Search ..... 238/29, 30, 36, 37, 238/83, 84; 428/106, 114, 529, 537, 541

[56] References Cited

U.S. PATENT DOCUMENTS

| | | | |
|---|---|---|---|
| 598,127 | 2/1898 | Williams | 238/83 X |
| 875,856 | 1/1908 | Shuman | 238/36 |
| 1,250,194 | 12/1917 | Lietz | 238/36 |
| 1,623,185 | 4/1927 | Hinde | 238/37 |
| 2,257,833 | 10/1941 | Bäseler et al. | 238/83 |
| 2,350,729 | 6/1944 | Crouet | 161/268 X |
| 2,859,187 | 11/1958 | Ropella | 161/162 UX |
| 2,986,782 | 6/1961 | Elmendorf | 161/268 X |
| 3,300,361 | 1/1967 | Brown | 161/162 X |
| 3,416,727 | 12/1968 | Collins | 238/84 |
| 3,793,125 | 2/1974 | Kunz | 161/162 X |
| 3,846,219 | 11/1974 | Kunz | 161/162 X |
| 3,865,681 | 2/1975 | Beebe | 161/268 X |

*Primary Examiner*—Randolph A. Reese
*Attorney, Agent, or Firm*—Evelyn M. Sommer

[57] ABSTRACT

A combination railroad tie for supporting railroad track rails on a ballast or concrete roadbed. The main body portion of the tie is wood, having a rectangular cross section and a flat upper and lower surface. A plurality of flat plastic plies made of shredded wood fibers or wood chips bonded together by a thermal setting resin are, in turn, bonded to the upper and lower surfaces of the main body portion.

5 Claims, 4 Drawing Figures

COMBINATION WOOD PLASTIC RAILROAD TIE

This is a continuation of application Ser. No. 516,586, filed Oct. 21, 1974 now abandoned.

BACKGROUND OF THE INVENTION

Railroad ties have been made of wood for many years, sometimes treated with a preservative such as coal tar creosote and sometimes used without any treatment at all. The ties are mostly used outdoors and therefore are subjected to weathering and attack by insects and mold. Railroad rails are fastened to the ties by spikes or screw fittings and therefore the ties must be capable of resisting splitting and chipping at the area near the fittings. Railroad ties are also subject to high bending and compression forces each time a train passes over the ties. Wooden ties are adapted to withstand such treatment because of their fibrous composition and this feature is one reason why wood ties are preferred above steel and concrete ties. Because of its inherent resiliency, the body of the railroad tie of this invention is made of wood.

Creosote inhibits the growth of fungi and other molds but, with age, cracks appear in the wood tie and mold initiates rapid decay and rotting. It is estimated that the average life of a railroad tie is only fifteen years. The bonding of resin secured plies to the top and bottom surfaces of a wood tie substantially eliminates cracking and splintering of the wood tie and greatly prolongs its life. Also, the plies reduce splitting of the wood where the spikes are placed to secure the rails to the tie.

SUMMARY

The invention includes a tie for supporting railroad track rails on a ballast or concrete roadbed and comprises a main body portion of wood having a rectangular cross section. A plurality of flat plies are positioned on the upper and lower surfaces of the body portion, each of the plies including a mass of shredded wood fibers or wood chips bound together to form a dense homogeneous mass by means of a thermal setting phenolformaldehyde resin. Bonding means for holding the upper plies, the lower plies and the main body portion together include layers of thermal setting phenol-formaldehyde resin applied between the junction surfaces of each of the components. The whole tie may or may not be treated with coal tar creosote or other preservatives.

The resistance of the lateral thrust of the spikes, and the spike holding power of the railroad tie depends mainly on its density, especially on the density of the tie along its top or uppermost surface. With the railroad tie of the subject invention, the top portion thereof is composed of one or more layers of high density fiberboard or particleboard. Therefore, it has high spike holding power and good resistance to the lateral thrust of the spike.

In the subject method of forming a railroad tie, the steps include positioning plies on the upper and lower portions of the main body portion, and bonding the elements to form a unitary structure.

Additional details of the invention will be disclosed in the following description, taken in connection with the accompanying drawings.

DESCRIPTION OF THE PREFERRED EMBODIMENT

Figure 1:
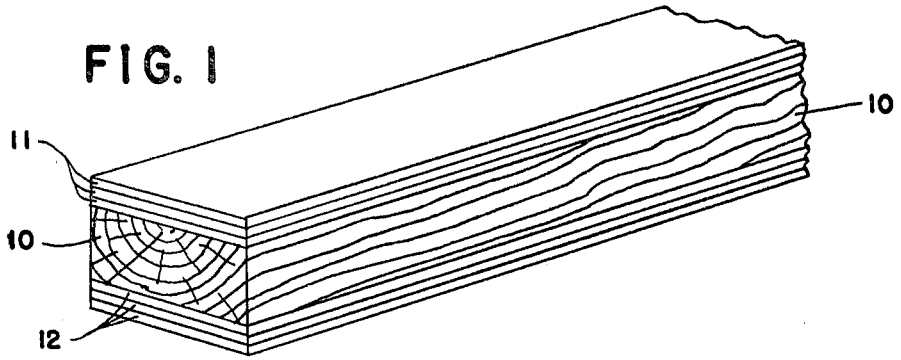
FIG. 1 is a perspective view of the preferred form of the invention, showing three plies of hardboard or particleboard on the upper surface of a wood tie and three plies of the same type on the lower surface.

Referring to FIG. 1 a railroad tie is shown having a main portion of wood 10, three plies of hardboard or particleboard 11 secured to the top surface of the main portion, and three similar plies 12 secured to the bottom surface. The entire lamination may be treated with coal tar creosote. The creosote inhibits the growth of mold and other rotting agents and greatly increases the useful life of the tie.

Each ply 11 and 12 is hardboard or particle-board of high resin content. The final combination tie is assembled in a press with three plies on the bottom, the wood beam in the center, and three plies on top. Each junction surface is supplied with a thin layer of uncured phenol-formaldehyde adhesive and the combination is put through a heat-pressure cycle to polymerize the resin and produce a single resilient railroad tie with smooth impervious top and bottom surfaces which resist cracking and splintering. An alternative approach is to use resorcinol formaldehyde adhesive and to effect curing of the adhesive under pressure at room temperature. The conventional spikes may be used to nail the nails to the tie.

Figure 2:
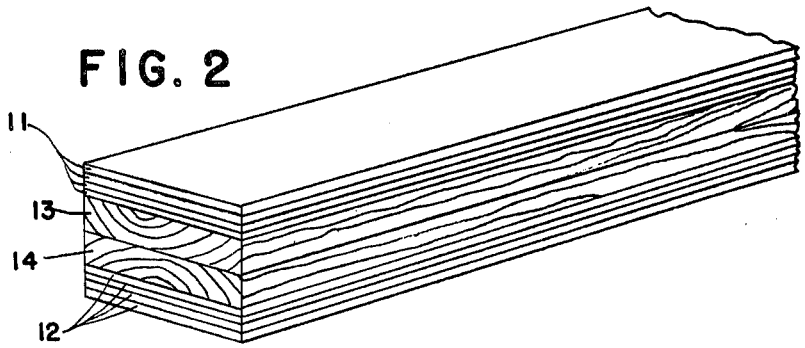
FIG. 2 is a view similar to FIG. 1, except that two layers of wood make up the main body portion.

The tie shown in FIG. 2 is formed with two wood portions 13 and 14, placed with the grain pattern in opposition in order to reduce the tendency to warp. Four plies of hardboard or particleboard 11 are shown on the upper wood surface and four plies 12 on the lower surface.

Figure 3:
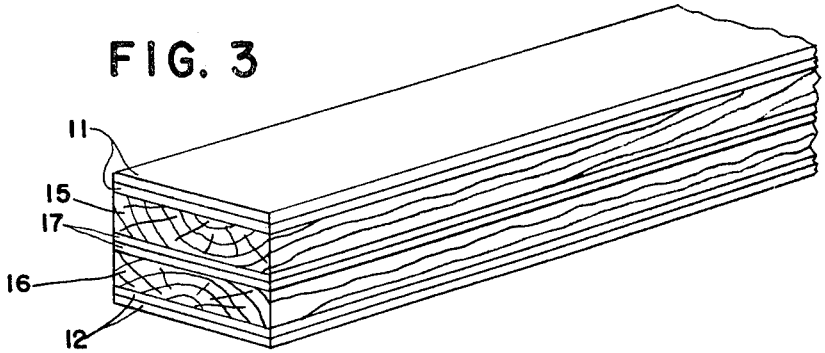
FIG. 3 is a view similar to FIG. 2 except that two plies of hardboard or particleboard have been added between the two layers of wood and that only two plies are each bonded to the upper and lower surfaces of the main body portion.

FIG. 3 shows another variation of the invention with two wood portions 15 and 16 separated by two plies or hardboard or particleboard 17. Two upper plies 11 and two lower plies 12 complete this composition tie.

Figure 4:
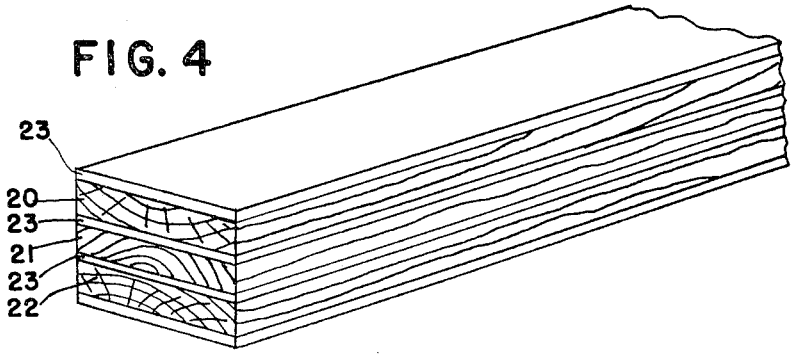
FIG. 4 shows still another alternate form of the invention, having three wood layers and four plies of hardboard or particleboard.

FIG. 4 shows an alternate form of the tie with three wood beams 20, 21, and 22. A single ply of hardboard or particleboard between the wood beams and a single ply 23 on the top and bottom surfaces.

All of the railroad ties shown in the figures have considerably greater strength than a single beam. In addition, the wood portions can be cut from smaller trees since their thickness is less than the standard tie. The resiliency of all types shown depends upon the fibrous content of the wood and the bonded fibers in the thermally cured plies. The end result is a composition tie having smooth top and bottom surfaces which resist cracking and splintering and also a high spike holding power.

The lumber used in the railroad tie may be hardwood or softwood of any species, and the specific gravity of the fiberboard or particleboard should be above 0.6 and preferably above 0.9. In addition, the resin content of the fiberboard or particleboard should be more than 5% and preferably more than 10%. The resin incorporated into the fiberboard or particleboard may be any one or any combination of the following resins:

(1) Phenol formaldehyde; (2) Melamine formaldehyde; (3) Resorcinol formaldehyde; (4) Urethane and other isocyanate-based resins; (5) Epoxy; and (6) other resins that can form a weather resistant glue bond which would be fibrous. In addition, the resin used to laminate the railroad tie may be formulated with said resins. In addition to the advantage of the subject invention which provides high spike holding power and good resistance to the lateral thrust of spikes, the high density fiberboard top portion of the subject tie also provides the tie with good resistance to wear under the rail or under the tieplate. Furthermore, with respect to the use of a main body portion, the railroad ties made according to the subject invention require lumber of smaller sizes than normally employed in conventional wood railroad ties which must be made from relatively large trees because the dimensions of railroad ties usually run from 5"×5"×5 ft. to 7"×9"×9 ft. Furthermore, in the subject laminated tie, minor defects of woods, such as knots, shakes, or splits become more tolerable because in the sandwich construction of the subject invention, the effect of minor wood defects becomes less significant. Furthermore, by the use of the subject invention, high quality railroad ties can also be made from soft or low density wood species, as contrasted to conventional high quality railroad ties which must be made from hard or high density wood species. In addition, the layer or layers of fiberboard or particleboard on the top and bottom portions of the subject laminated railroad tie keep cracks from developing on these two surfaces. Thus, the service life of the subject railroad tie is prolonged.

I claim:

1. A railroad tie for supporting railroad track rails on a ballast or concrete roadbed comprising: a main body portion of natural wood made up of two or more wood sections of rectangular cross section, each as wide as the tie, having a rectangular cross section of sufficient size to grippingly receive a rail spike; a plurality of preformed flat plies positioned on and coextensive with the broader surfaces of said body portion in compressive strength reinforcing relationship therewith, each of said plies including a mass of shredded wood fibers or wood chips bound together to form a dense homogeneous mass by a cured thermal setting resin; a further plurality of said preformed flat plies positioned between said wood sections; and bonding means joining the plies to said surface of the main body portion to form a unitary railroad tie structure with sufficient compressive strength to operatively support rails mounted thereon with enhanced surface wear resistance from the protection of said plies overlying the broader surface of said main body portion, said bonding means consisting essentially of a layer of cured thermal setting resin between each of said components for high rail retention strength while imparting resistance against cracking of the main body portion when a rail spike is applied.

2. A tie as claimed in claim 1 wherein the grain of the main body portion is aligned with the greatest dimension of the tie.

3. A tie as claimed in claim 1 wherein said plies are less than one-half inch in thickness.

4. A tie as claimed in claim 1 wherein the same number of up to three of said plies are secured to each broad surface of the main body.

5. A tie as claimed in claim 1 wherein the resin is phenol-formaldehyde or resorcinol-formaldehyde resin.

* * * * *